US006155139A

United States Patent [19]

Tanji

[11] Patent Number: 6,155,139

[45] Date of Patent: Dec. 5, 2000

[54] PNEUMATICALLY OPERABLE SCREW DRIVER

[75] Inventor: Isamu Tanji, Hitachinaka, Japan

[73] Assignee: Hitachi Koki Co., Ltd., Tokyo, Japan

[21] Appl. No.: 09/315,063

[22] Filed: May 20, 1999

[30] Foreign Application Priority Data

May 20, 1998 [JP] Japan ..... 10-138990

[51] Int. Cl.[7] ..... B25B 13/00

[52] U.S. Cl. ..... 81/57.44; 81/57.31; 81/434; 173/93.5

[58] Field of Search ..... 81/57.44, 57.31, 81/57.42, 434; 173/177, 176, 93.6, 93.5

[56] References Cited

U.S. PATENT DOCUMENTS

| | | | |
|---|---|---|---|
| 4,059,034 | 11/1977 | Hornung | 81/57.37 |
| 4,920,836 | 5/1990 | Sugimoto et al. | 81/463 |
| 5,231,902 | 8/1993 | Uno et al. | 81/57.44 |
| 5,730,035 | 3/1998 | Ohmori et al. | 81/57.44 |

FOREIGN PATENT DOCUMENTS

| | | |
|---|---|---|
| 19653211 A1 | 6/1997 | Germany . |
| 19911706 A1 | 9/1999 | Germany . |
| 61-75966 | 5/1986 | Japan . |
| 7-18531 | 5/1995 | Japan . |

*Primary Examiner*—James G. Smith
*Assistant Examiner*—Hadi Shakeri
*Attorney, Agent, or Firm*—Louis Woo

[57] ABSTRACT

An air motor is provided in a housing and driven by the compression air introduced from an intake port. An anvil, receiving the rotational force of the air motor, has a rear end accommodated in the housing and a front end protruding out of the housing. A driver bit, engaged with a screw inserted into a board member, is rotatable and shiftable together with the anvil relative to the housing. An intake valve is responsive to a retractile shift movement of the driver bit to open an air passage connecting the intake port to the air motor. The intake valve closes this air passage in response to a protrusile shift movement of the driver bit returning to its original position so as to stop the air motor. An assist means is provided for applying the pressure of the compression air to a rear end surface of the anvil in response to the rotation of the air motor.

10 Claims, 7 Drawing Sheets

PNEUMATICALLY OPERABLE SCREW DRIVER

BACKGROUND OF THE INVENTION

The present invention relates to a pneumatically operable screw driver preferably used for inserting a threaded fastening member into a board member such as a wood material or the like.

FIG. 6 shows a conventional screw driver disclosed in the unexamined Japanese utility model publication No. 61-75966. This conventional screw driver has an air motor 102 and a driver bit 109 driven by a driving force of the air motor 102. The rotation of the air motor 102 is transmitted via a speed-reduction mechanism 120 to an anvil 110. The speed-reduction mechanism 120 is constituted by a planetary gear 172 or the like. The driver bit 109 is detachably engaged with the front end of the anvil 110. The driver bit 109 and the anvil 110 are slidable in the axial direction of a cylindrical body 101 of the screw driver. The driver bit 109 has a tip engageable with a head 131 of a screw 130. The operator pushes the screw driver body 101 in the axial direction. A pressing force applied on the driver bit 109 acts against the screw 130 placed at a position corresponding to an engaging hole 129*a* of a board member 129.

In this case, the driver bit 109 receives a reaction force from the screw 130 pressed against the board member 129. The driver bit 109 thus causes a retractile (i.e., rearward) shift movement relative to the screw driver body 101. The driver bit 109 and the anvil 110 shift together in the axial direction of the screw driver body 101. An operation rod 117 has a front end inserted in an engagement bore formed at the rear end of the anvil 110. In response to the retractile shift movement of the anvil 110, the operation rod 117 lifts an intake valve 107 upward. An intake port 104 is provided at the rearmost end of the screw driver. When the intake valve 107 is lifted upward, an air passage 106*a* connects the intake port 104 to the air motor 102 so as to supply the compression air into the air motor 102. The air motor 102 starts its operation.

In this manner, the air motor 102 is activated in response to the retractile shift movement of the driver bit 109 (and the anvil 110) relative to the screw driver body 101. When the screw driving operation is finished, the operator releases the pushing force applied on the screw driver body 101. Thus, the driver bit 109 shifts oppositely in the axial direction relative to the screw driver body 101 and returns to the original position. The operation rod 117 also returns to its original position. Thus, the intake valve 107 moves downward to close the air passage 106*a*. No compression air is supplied to the air motor 102. The air motor 102 is stopped.

A driver guide 112 has a cylindrical body with a rear end threaded and engageable with a cylindrical inner wall of a front sleeve of the screw driver body 101. The driver guide 112 has an axial hole along which the driver bit 109 is slidable in the back-and-forth direction. The axial position of the driver guide 112 with respect to the screw driver body 101 is changeable by rotating the driver guide 112 about its axis. In other words, the length of the driver bit 109 protruding from the front end of the driver guide 112 is adjustable by rotating the driver guide 112. Accordingly, the driver guide 112 makes it possible to restrict the fastening depth of the screw 130 to a constant value.

The screw driving operation of the above-described conventional screw driver will be explained with reference to FIGS. 7A to 7C. In this case, the axial position of the driver guide 112 is adjusted beforehand to optimize the protrusile length of the driver bit 109 to a designated position. Through this adjustment using the driver guide 112, when the screw 130 is completely inserted into the board member 129 by the driver bit 109, the head 131 of the screw 130 becomes flush with the upper surface of the board member 129.

First, in the beginning of the screw driving (or fastening) operation, a cross-shaped (ridged) tip of the driver bit 109 is engaged with a corresponding cross groove formed on the head 131 of the screw 130. The operator pushes the screw driver body 101 in the axial direction to press the driver bit 109 against the screw 130 placed in the engaging hole 129*a* of the board member 129. The operation rod 117 receives the reaction force from the board member 129 via the screw 130, the driver bit 109 and the anvil 110. The operation rod 117 is thus shifted upward to open the intake valve 107. Upon opening the intake valve 107, the compression air flows into the air motor 102 from the intake port 104 via the air passage 106*a*. The air motor 102 starts rotating. The driver bit 109 rotates to fasten the screw 130 into board member 129, as shown in FIG. 7A.

During the screw driving operation, the front end of the driver guide 112 comes to contact with the board member 129 when the screw head 131 reaches an altitudinal height "d" from the board member 129, as shown in FIG. 7B. The distance "d" is identical with an opening clearance of the intake valve 107. The opening clearance of the intake valve 107 is defined by the axial lift amount of the intake valve 107. After the driver guide 112 is brought into contact with the board member 129, the driver bit 109 does not receive the reaction force from the board member 129. At this moment, the screw 130 is still driven into the board member 129. The driver bit 109 continues driving the screw 130 forward until the intake valve 107 is closed. After the driver bit 109 advances forward together with the operation rod 117 by an amount equivalent to the clearance "d", the intake valve 107 is closed as shown in FIG. 7C. The air motor 102 is stopped. At this moment, the screw head 131 is positioned in flush with the upper surface of the board member 129. The screw driving operation is completed in this manner.

The above-described screw driver is generally referred to as "push-start type screw driver" characterized in that the air motor 102 is automatically activated by pushing the screw driver body 101 under the condition where the driver bit 109 is engaged with the screw 130. This realizes the speedy handling of the screw driver, improving the workability. The provision of the driver guide 112 makes it possible to restrict the fastening depth of the screw 130 to a constant value, assuring the good finish in the screw driving operation.

However, the generally used screw is a Phillips type screw having on its head a recess in the shape of a cross. The operator needs to continuously apply a predetermined torque on the driver bit 109 engaged with the cross groove on the screw head 131. If the torque applied on the driver bit 109 is smaller than this predetermined torque, the driver bit 109 will shift upward due to the reaction force caused by the fastening torque of the driver bit 109 itself. Thus, the driver bit 109 tends to exit out of the cross groove of the screw head 131. This behavior is generally referred to as a "come-out" phenomenon which causes the slipping engagement between the driver bit 109 and the screw head 131. The "come-out" phenomenon may damage the cross groove on the screw head 131. The tip of the driver bit 109 will wear at an early stage.

In general, it is possible to suppress the "come-out" phenomenon as long as the driver bit 109 and the anvil 110 are positioned at the uppermost position with a sufficient pressing force applied on the screw driver.

As described above, using the driver guide 112 is effective to obtain a constant fastening depth. However, the presence of the driver guide 112 possibly causes the "come-out" phenomenon. As explained with reference to FIG. 7B, the driver bit 109 does not receive a sufficient reaction force from the screw 130 after the driver guide 112 is brought into contact with the board member 129. During the remaining fastening operation from the condition of FIG. 7B to the condition of FIG. 7C, the driver bit 109 causes a protrusile shift movement together with the anvil 110 relative to the screw driver body 101. In this case, the driver bit 109 continues fastening the screw 130 with a pressing force applied on the anvil 110 by the spring 118 provided above the intake valve 107. The resilient force of the spring 118 is relatively small. Accordingly, in the final fastening operation (i.e., the protrusile shift movement of the driver bit 109 and the anvil 110) from the condition of FIG. 7B to the condition of FIG. 7C, the driver bit 109 and the anvil 110 may cause an undesirable retractile shift movement relative to the screw driver body 101 due to the reaction force caused by the fastening torque of the driver bit 109 itself. Thus, the "come-out" phenomenon is possibly caused in the final stage of the screw driving operation.

Furthermore, the board member 129 may be made of a soft material, such as a gypsum or plaster board. In such cases, the soft board member 129 may induce the "come-out" phenomenon. The screw 130 is easily inserted into the soft board member 129. The driver bit 109 will not receive a sufficient reaction force from the screw 130 if the fastening speed of the driver bit 109 is slow.

The spring 118, provided above the intake valve 107, always urges the driver bit 109 and the anvil 110 downward. To prevent the "come-out" phenomenon, it is possible to set the load of the spring 118 to a larger value exceeding the reaction force of the fastening torque. However, such a setting forces the operator to strongly push the screw driver against an excessively large force equivalent to the increased resilient force of the spring 118. The operability of the screw driver is significantly worsened.

SUMMARY OF THE INVENTION

An object of the present invention is to provide a pneumatically operable screw driver capable of solving the problems of the conventional screw driver as well as suppressing the "come-out" phenomenon, and also capable of providing excellent workability.

In order to accomplish this and other related objects, the present invention provides a pneumatically operable screw driver comprising a housing with an intake port connected to a compression air source supplying the compression air. An air motor is provided in the housing and is driven by the compression air introduced from the intake port. An anvil has a rear end accommodated in the housing and a front end protruding out of the housing. A transmission mechanism is provided between the air motor and the anvil for transmitting the rotation of the air motor to the anvil. A driver bit is securely held at a front end of the anvil so as to be shiftable together with the anvil relative to the housing. A resilient means is provided for resiliently urging the driver bit and the anvil in a protrusile direction. The resilient means is also for allowing the driver bit and the anvil to shift in a retractile direction relative to the housing when the driver bit receives a reaction force from a screw inserted into a board member. The intake port is connected to the air motor via an air passage. An intake valve is responsive to the retractile shift movement of the driver bit to open the air passage. When the intake valve is opened, the compression air is supplied from the intake port to the air motor to rotate the air motor. Furthermore, the intake valve closes the air passage in response to a protrusile shift movement of the driver bit returning to its original position so as to stop the air motor. An assist means is provided for applying the pressure of the compression air to a rear end surface of the anvil in response to the rotation of the air motor.

According to a preferred embodiment of the present invention, the compression air is introduced into an inside space of the housing to apply the pressure of the compression air to the rear end surface of the anvil in response to the rotation of the air motor, and the compression air is discharged in response to the stop of the air motor.

Preferably, an auxiliary passage is provided to introduce the compression air to the inside space of the housing facing the rear end surface of the anvil.

The inside space of the housing facing the rear end surface of the anvil is hermetically sealed so that the introduced compression air is stored at a satisfactory pressure level in the inside space.

The auxiliary passage has a cross section smaller than that of the air passage connecting the intake port to the air motor.

Furthermore, an auxiliary passage is provided to discharge the compression air from the inside space of the housing facing the rear end surface of the anvil. This auxiliary passage has a cross section smaller than that of an exhaust passage discharging the compression air from the air motor.

The auxiliary passage is connected to the air passage connecting the intake port to the air motor.

Preferably, the driver bit is surrounded by a driver guide. The driver guide is detachably attached to the housing and slidable in an axial direction of the housing so that a protruding length of the driver bit can be adjusted by shifting the driver guide relative to the housing.

Preferably, a screw feeding mechanism is detachably attached to the housing. The screw feeding mechanism comprises a slider resiliently urged in a protrusile direction by a spring and slidable in the axial direction of the driver bit, and a wheel having a cylindrical outer periphery along which a plurality of projections are provided at uniform intervals to hold a flexible band of a screw assembly. The wheel is rotatably supported at the front end of the slider to supply each screw of the screw assembly to a position meeting with the axis of the driver bit in synchronism with the sliding motion of the slider.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
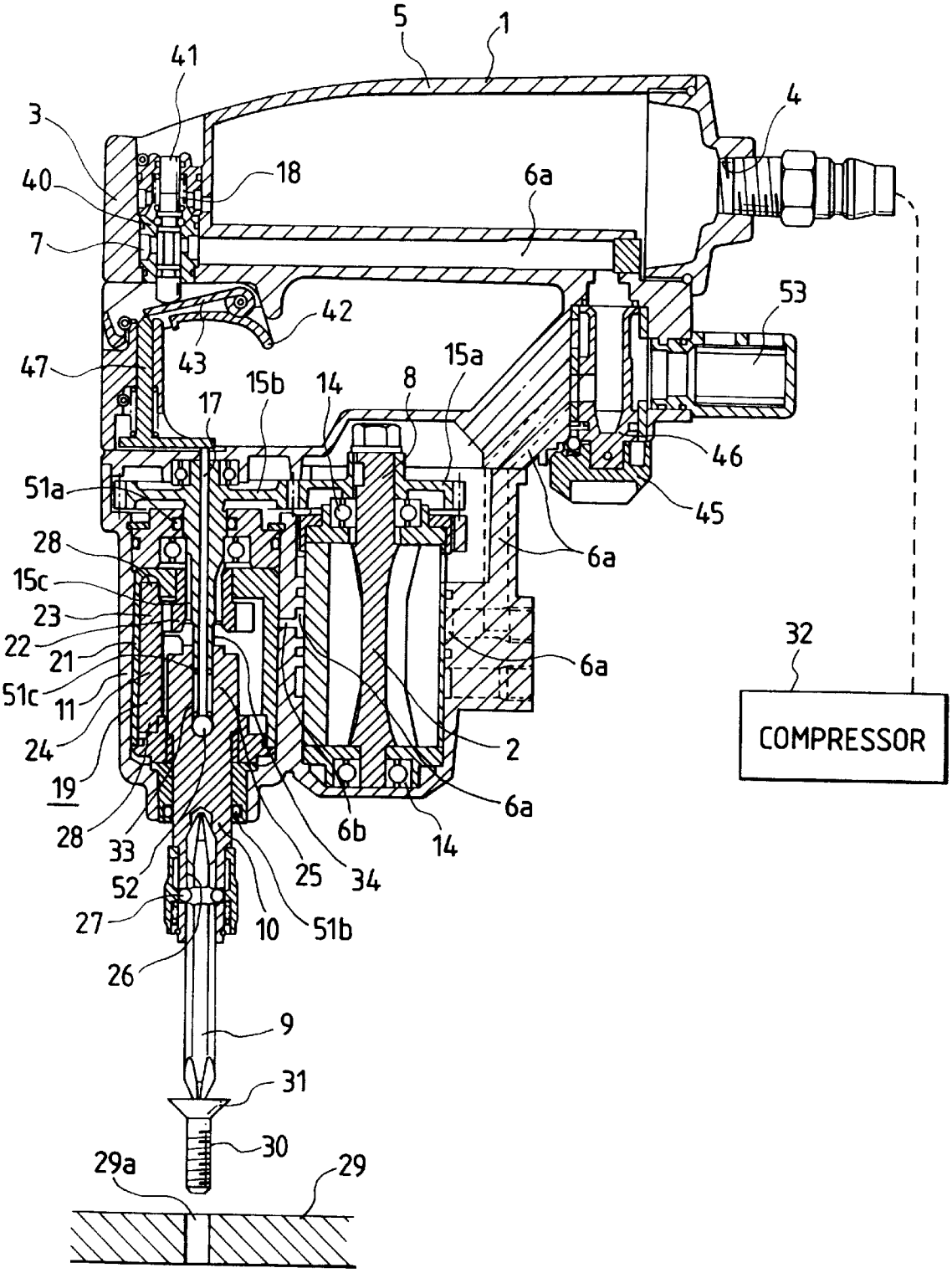
FIG. 1 is a vertical cross-sectional view showing a pneumatically operable screw driver in accordance with a preferred embodiment of the present invention.

Preferred embodiments of the present invention will be explained with reference to the attached drawings. Identical parts are denoted by the same reference numerals throughout the views. The directions used in the following explanation are defined based on a screw driver held in a vertical position with a driver bit extending downward and a handle extending in a horizontal direction. Needless to say, the actual direction of the screw driver will be frequently changed due to its handiness when it is used.

Figure 2:
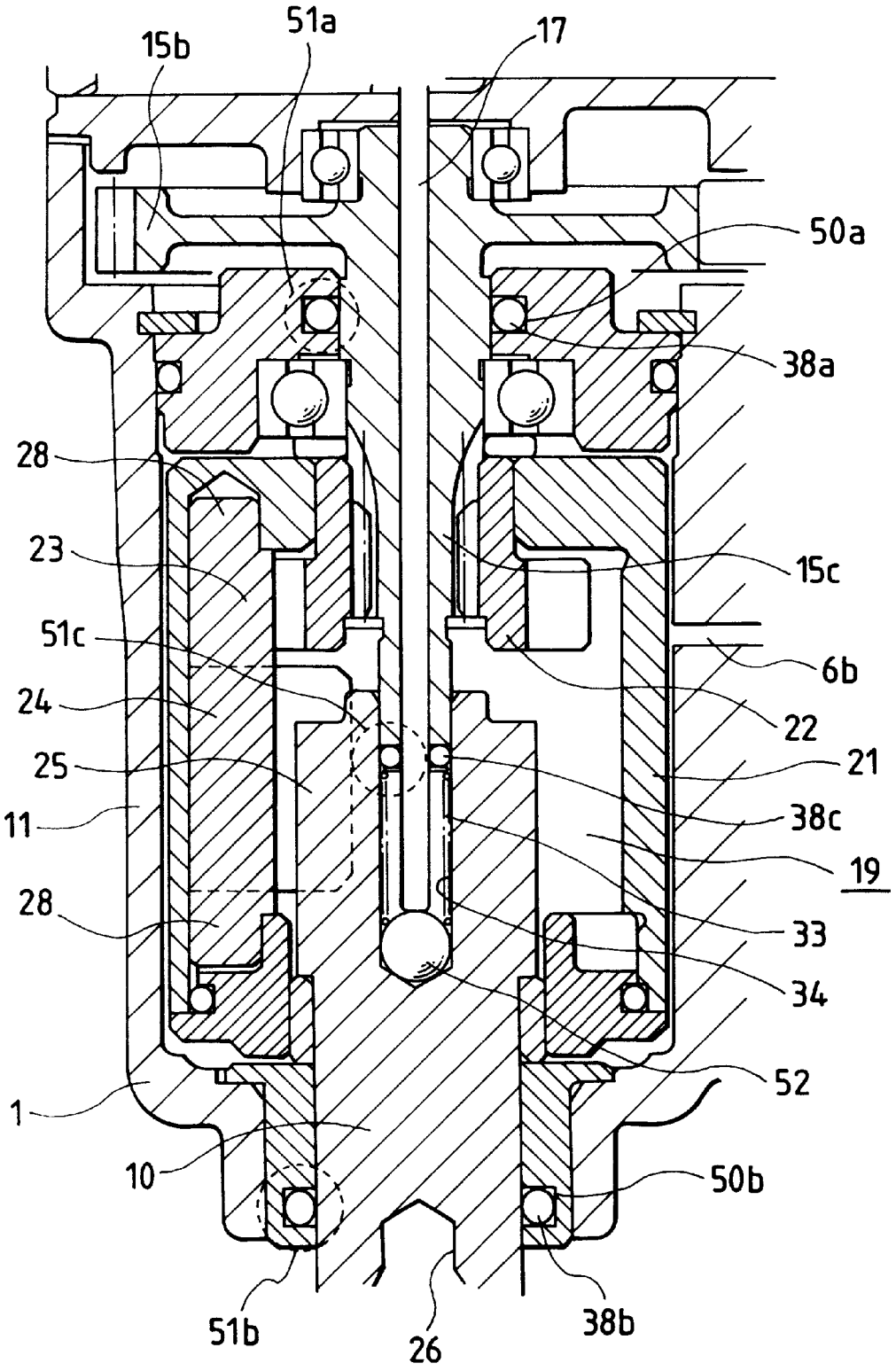
FIG. 2 is an enlarged cross-sectional view showing a nose portion of the pneumatically operable screw driver shown in FIG. 1.

FIGS. 1 and 2 cooperatively show a screw driver in accordance with a preferable embodiment of the present invention. A screw driver body 1 has a housing 3 with an intake port 4 and a handle 5. A nose casing 11, constituting a front (i.e., lower) part of the housing 3, accommodates an air motor 2 and an impact mechanism 19 disposed in parallel with each other. The impact mechanism 19 serves as a speed-reduction mechanism for reducing the speed of the air motor 2. The air motor 2 and the impact mechanism 19 are connected via a pair of meshing gears 15*a* and 15*b* disposed at an upper side closer to the handle 5.

An anvil 10 is rotatable by the impact mechanism 19 provided in the nose casing 11. The rear end of the anvil 10 is accommodated in the nose casing 11. The front end of the anvil 10 protrudes out of the nose casing 11. A driver bit 9 is securely held in a bore formed at the front end of the anvil 10. The driver bit 9 and the anvil 10 are shiftable in the axial direction of the nose casing 11. A spring 33, provided between the gear 15*b* and the anvil 10, resiliently urges the driver bit 9 in a protrusile direction (i.e., downward). An operation rod 17 is responsive to the axial shift movement of the driver bit 9 shiftable together with the anvil 10. An intake valve 7, shifting together with the operational rod 17, opens or closes an air passage 6*a* supplying the compression air from the intake port 4 to the air motor 2. When the compression air is supplied, the air motor 2 starts rotating. In other words, the air motor 2 is activated or deactivated in accordance with the opening and closing of the intake valve 7.

A clutch shank 25 is provided at the rear end of the anvil 10. The clutch shank 25 and the impact mechanism 19 are accommodated in the nose casing 11. An inside space of the nose casing 11 is connected to the air passage 6*a* via an auxiliary passage 6*b*. The compression air, introduced into the air motor 2 in response to the opening of the intake valve 7, is partly supplied into the inside space of the nose casing 11. The auxiliary passage 6*b* has a cross section (or a diameter) smaller than that of the air passage 6*a*.

Hereinafter, the arrangement of the above-described screw driver of the present invention will be explained in greater detail.

The intake valve 7 is positioned rearward than the anvil 10. The intake valve 7 has a cylindrical valve housing 40. A valve stem 41 is slidably inserted in the cylindrical housing 40. A spring 18 resiliently urges the valve stem 41 to close the intake valve 7.

An operator pulls a trigger 42 provided at an appropriate portion of the handle 5. At the same time, the operation rod 17 shifts upward together with the anvil 10. The upper shift movement of the operation rod 17 is linked with a clockwise rotation of a swing arm 43 via a push lever 47. The swing arm 43 pushes the valve stem 41 upward against the resilient force of the spring 18. The intake valve 7 is opened to supply the compression air from the intake port 4 to the air passage 6*a*.

When the operator releases the trigger 42, or when the operation rod 17 is shifted downward, the valve stem 41 returns to the original position by the resilient force of the spring 18. Thus, the intake valve 7 is closed. No compression air is supplied from the intake port 4 to the air motor 2.

The rotational direction of the driver bit 9 is switched in the following manner. A switching valve 45 has a valve stem 46 rotatable in both a clockwise direction and a counter-clockwise direction. There are two air supply portions selectively connected to the air motor 2 by turning the switching valve 45. One air supply portion is connected to the air motor 2 to rotate the air motor 2 in one direction. The other air supply portion is connected to the air motor 2 to rotate the air motor 2 in the opposite direction. The rotational direction of the driver bit 9 is changed in accordance with the change of the rotational direction of the air motor 2.

The air motor 2 has a rotary shaft 8 with axial ends supported by bearings 14 and 14. The rear (i.e., upper) end of the rotary shaft 8 is securely fixed to the gear 15*a*. The gear 15*a* meshes with the opposing gear 15*b* provided at the rear end of the impact mechanism 19. The rotation of the air motor 2 is transmitted via the gears 15*b* and 15*a* to a cam 22 serving as a part of the impact mechanism 19. The cam 22 has a hole into which an axially extending cylindrical portion 15*c* of the gear 15*b* is inserted. The cam 22 is securely fixed to the gear 15*b*.

The cam 22 is rotatable relative to a clutch frame 21 within a predetermined angle. A dog clutch 24, integrally supported by a shaft 28, is rotatable relative to the clutch frame 21. An engaging portion 23 provided at one side of the dog clutch 24 is engaged with the cam 22. The cam 22 causes the dog clutch 24 to rotate by a predetermined angle. The edge of the dog clutch 24 repetitively hits the working edge of the clutch shank 25. With this repetitive hitting operation, the anvil 10 receives the impact force intermittently and rotates about its shaft. The anvil 10 is integrally formed with the clutch shank 25. The cam 22, the clutch frame 21, the dog clutch 24, and the clutch shank 25 cooperatively constitute the impact mechanism 19.

The nose casing 11 has a hermetically sealed inside space. The impact mechanism 19 and the rear end of the anvil 10 are accommodated in the hermetically sealed inside space of the nose casing 11. As shown in FIG. 2, a rear sealing portion 51*a* is provided at the rear end of the nose casing 11 to seal the outer peripheral surface of the cylindrical portion 15*c* of the gear 15*b*. The rear sealing portion 51*a* comprises an O-ring 38*a* coupled in a circular groove 50*a*. The O-ring 38*a* has an inner diameter slightly smaller than the outer diameter of the sealed portion of the cylindrical portion 15*c*. Thus, the O-ring 38*a* is resiliently fastened around the outer peripheral surface of the cylindrical portion 15*c* of the gear 15*b*. No clearance is provided between the O-ring 38*a* and the cylindrical portion 15*c* of the gear 15*b*.

A front sealing portion 51*b* is provided at the front end of the nose casing 11 to seal the outer peripheral surface of the cylindrical body of the anvil 10. The front sealing portion 51*b* comprises an O-ring 38*b* coupled in a circular groove 50*b*. The O-ring 38*b* has an inner diameter slightly smaller than the outer diameter of the sealed portion of the anvil 10. Thus, the O-ring 38*b* is resiliently fastened around the outer peripheral surface of the anvil 10. No clearance is provided between the O-ring 38*b* and the anvil 10. A central sealing portion 51*c* is provided at a radial center of the nose casing 11 to seal the outer peripheral surface of the operation rod 17. The central sealing portion 51*c* comprises an O-ring 38*c* having an inner diameter slightly smaller than the outer diameter of the sealed portion of the operation rod 17. Thus, the O-ring 38*c* is resiliently fastened around the outer peripheral surface of the operation rod 17.

When the compression air is introduced into the inside space of the nose casing 11, the O-ring 38*a* is pushed rearward (i.e., upward) by the pressure of the compression air entering in the groove 50*a*. Thus, the O-ring 38*a* as a sealing is brought into hermetical contact with the inside wall (i.e., upper side) of the groove 50*a*. Due to the cylindrical shape of the O-ring 38*a*, the rotational friction is small. A transmission loss of the driving force from the air motor 2 to the driver bit 9 can be minimized. The sealing ability of the O-ring 38*a* is adequately maintained even after the O-ring 38*a* wears a certain amount, since the O-ring 38*a* can keep hermetical contact with the inside wall of the groove 50*a* by the compression air. In other words, the O-ring 38*a* has a long life.

The O-ring 38*b* of the front sealing portion 51*b* has the function similar to that of the O-ring 38*a* of the rear sealing portion 51*a*. When the compression air is introduced into the inside space of the nose casing 11, the O-ring 38*b* is pushed forward (i.e., downward) by the pressure of the compression air entering in the groove 50*b*. Thus, the O-ring 38*b* as a sealing member is brought into hermetical contact with the inside wall (i.e., lower side) of the groove 50*b*.

The operation rod 17 is securely inserted into the cylindrical portion 15*c* of the gear 15*b*. The front (i.e., lower) end of the cylindrical portion 15*c* is coupled with a rear end bore 34 of the anvil 10. The front (i.e., lower) end of the operation rod 17 is inserted in this rear end bore 34 of the anvil 10. The central sealing portion 51*c* is located near the front edge of the cylindrical portion 15*c* of the gear 15*b*. The central sealing portion 51*c* is provided so as to seal the clearance between the front end of the operation rod 17 and the inner wall of the rear end bore 34 of the anvil 10.

A ball 52 is located in the bottom of the rear end bore 34 of the anvil 10. The front (i.e., lower) end of the operation rod 17 is brought into contact with the ball 52. The O-ring 38*c* of the central sealing portion 51*c* has an inner diameter slightly smaller than the outer diameter of the operation rod 17 and an outer diameter slightly smaller than the inner diameter than the rear end bore 34 of the anvil 10. The spring 33, located above the ball 52, resiliently urges the O-ring 38*c* rearward (i.e., upward). The O-ring 38*c* is thus pressed in the axial direction against the front end of the cylindrical portion 15*c* of the gear 15*b*. The O-ring 38*c* rotates together with the gear 15*b*. Thus, a rotational friction (i.e., resistive force) given from the sealing portion 51*c* to the anvil 10 is small. When the compression air is introduced into the inside space of the nose casing 11, the O-ring 38*c* is pushed upward by the compression air. Thus, the compression air adequately maintains the sealing ability of the O-ring 38*c*.

Upon opening the intake valve 7, the compression air flows into the air motor 2 from the intake port 4 via the air passage 6*a*. The air motor 2 starts rotating. Meanwhile, part of the compression air flows into the inside space of the nose casing 11, because the inside space of the nose casing 11 communicates with the air passage 6*a* via the auxiliary passage 6*b*. The cross section (or the diameter) of the auxiliary passage 6*b* is smaller than that of the air passage 6*a*. Thus, the inside pressure of the nose casing 11 increases gradually. The compression air, introduced from the auxiliary passage 6*b* into the nose casing 11, enters the back space of the anvil 10 via the clearance between the cylindrical portion 15*c* of the gear 15*b* and the cam 22.

The lower portion of the anvil 10 protrudes from the front end of the nose casing 11. Due to the increased inside pressure of the nose casing 11, a pressing force is applied to the rear end surface of the anvil 10. The pressing force applied on the rear end surface of the anvil 10 is proportional to the inside pressure of the nose casing 11.

When the intake valve 7 is closed, no compression air is supplied from the intake port 4 to the air passage 6*a*. The air motor 2 is stopped. The residual compression air in the air passage 6*a* and the air motor 2 is discharged to the outside through an exhaust port 53. The residual compression air in the nose casing 11 is discharged via an exhaust route consisting of the auxiliary passage 6*b*, the air passage 6*a*, and the exhaust port 53. In this case, the discharge of the compression air from the inside space of the nose casing 11 is delayed due to the orifice effect of the narrowed auxiliary passage 6*b*. As described above, the auxiliary passage 6*b* has a cross section smaller than that of the air passage 6*a*. The reduction of the pressure level in the nose casing 11 is substantially delayed compared with that of the air passage 6*a* or the air motor 2. Thus, the pressing force applied on the rear end surface of the anvil 10 is reduced slowly. In other words, the pressing force applied on the rear end surface of the anvil 10 is adequately maintained for a while even after the air motor 2 is stopped.

The anvil 10 has a polygonal bore 26 extending in the axial direction from the front end thereof. The polygonal shape of the bore 26 is substantially identical with that of the driver bit 9 so as to prevent the driver bit 9 from rotating relative to the anvil 10. A plurality of balls 27 are engaged in the holes opened at a front end sleeve of the anvil 10. The driver bit 9 has a ring recess for receiving the balls 27. The driver bit 9 is thus locked by the balls 27 so as not to shift in the axial direction.

The ball 52, placed in the bottom of the rear end bore 34 of the anvil 10, has the function for preventing the rotation of the anvil 10 from being transmitted to the operation rod 17.

The anvil 10 is shiftable in the axial direction against the resilient force of the spring 33. When the anvil 10 shifts in a retractile direction relative to the gear 15*b*, the operation rod 17 shifts together with the anvil 10. The intake valve 7 is opened when the operation rod 17 is lifted by a predetermined axial distance. On the other hand, the anvil 10 shifts in a protrusile direction by the same axial distance to return to the original position after the intake valve 7 is closed.

The anvil 10 is coaxial with the driver bit 9 and rotates integrally with the driver bit 9. The anvil 10 receives a resistive force during the driving operation of the screw 30. The resistive force is transmitted from a screw head 31 via the driver bit 9. This resistive force causes an angular dislocation of the dog clutch 24 relative to the clutch shank 25 of the anvil 10. The dog clutch 24 rotates together with the clutch frame 21 around the clutch shank 25 of the anvil 10.

The rotation of the dog clutch 24 is intermittently transmitted as a percussion force to the clutch shank 25. The anvil 10 and the driver bit 9 is driven (i.e., rotated) by such repetitive percussion operations. The operation rod 17, axially moving together with the anvil 10 and the driver bit 9, opens or closes the intake valve 7.

Next, the operation of the above-described screw driver will be explained with reference to FIGS. 1 and 2.

The operator engages the tip of the driver bit 9 with the cross groove on the screw head 31. Then, the operator sets the screw 30 at the position corresponding to an engaging hole 29*a* of a board member 29. The operator pulls the trigger 42, while pushing the screw driver body 1 toward the board member 29. Receiving a reaction force from the board member 29 via the screw 30, the driver bit 9 shifts in the retractile direction relative to the screw driver body 1. The anvil 10, the operation rod 17 and the push lever 47 shift upward together with the driver bit 9. The swing arm 43, being pushed upward by the push lever 47, rotates in a clockwise direction. The valve stem 41 is lifted upward against the resilient force of the spring 18. The intake port 4 communicates with a compressor 32 serving as a compression air source. Upon opening the intake valve 7, the compression air is supplied from the intake port 4 to the air motor 2 via the air passage 6*a*. The air motor 2 starts rotating.

When the air motor 2 rotates, the rotation of its rotary shaft 8 is transmitted via the gears 15*a*, 15*b* to the impact mechanism 19 accommodated in the nose casing 11. The impact mechanism 19 intermittently transmits the impact force to the rear end of the anvil 10. Through the repetitive impact forces given from the impact mechanism 19, the anvil 10 rotates together with the driver bit 9. The driver bit 9 fastens the screw 30 engaged at the tip thereof. When the air motor 2 is rotating, the compression air is introduced in the inside space of the nose casing 11 via the air passage 6*a* and the auxiliary passage 6*b*. The pressure level in the nose casing 11 is gradually increased.

The increased pressure is applied as a pressing force on the rear end surface of the anvil 10. The increased pressure is stored in the nose casing 11. In the beginning of the operation of the air motor 2, i.e., in the beginning of the screw driving operation, the anvil 10 receives an initial load equivalent to a sum of spring forces of the springs 18 and 33. The operator pushes the screw driver body 1 to apply a pushing force on the driver bit 9 against the spring forces of the springs 18 and 33. When the pushing force exceeds the initial load, the driver bit 9 shifts upward. The anvil 10, the operation rod 17 and the push lever 47 shifts together with the driver bit 9. Thus, the intake valve 7 is opened. The initial load is sufficiently small and comparable with that of the conventional push-start type screw driver.

As described above, the present invention provides an arrangement for applying the pressing force on the rear end surface of the anvil 10 during the screw driving operation. This arrangement prevents the driver bit 9 from being disengaged from the screw head 31. The anvil 10, pressed in the protrusile direction (i.e., downward) by the pressing force of the compression air, pushes the driver bit 9 toward the screw 30 until the screw driving operation is completed. Thus, the present invention effectively suppresses the "come-out" phenomenon.

Even when the operator reduces the pressing force applied on the screw driver body 1, the driver bit 9 is surely pressed toward the screw 30 by the pressure of the compression air applied on the rear end surface of the anvil 10. Thus, the present invention suppresses the "come-out" phenomenon.

Another embodiment of the present invention may have a driver guide attached on the front end of the above-described pneumatically operable screw driver.

Figure 3:
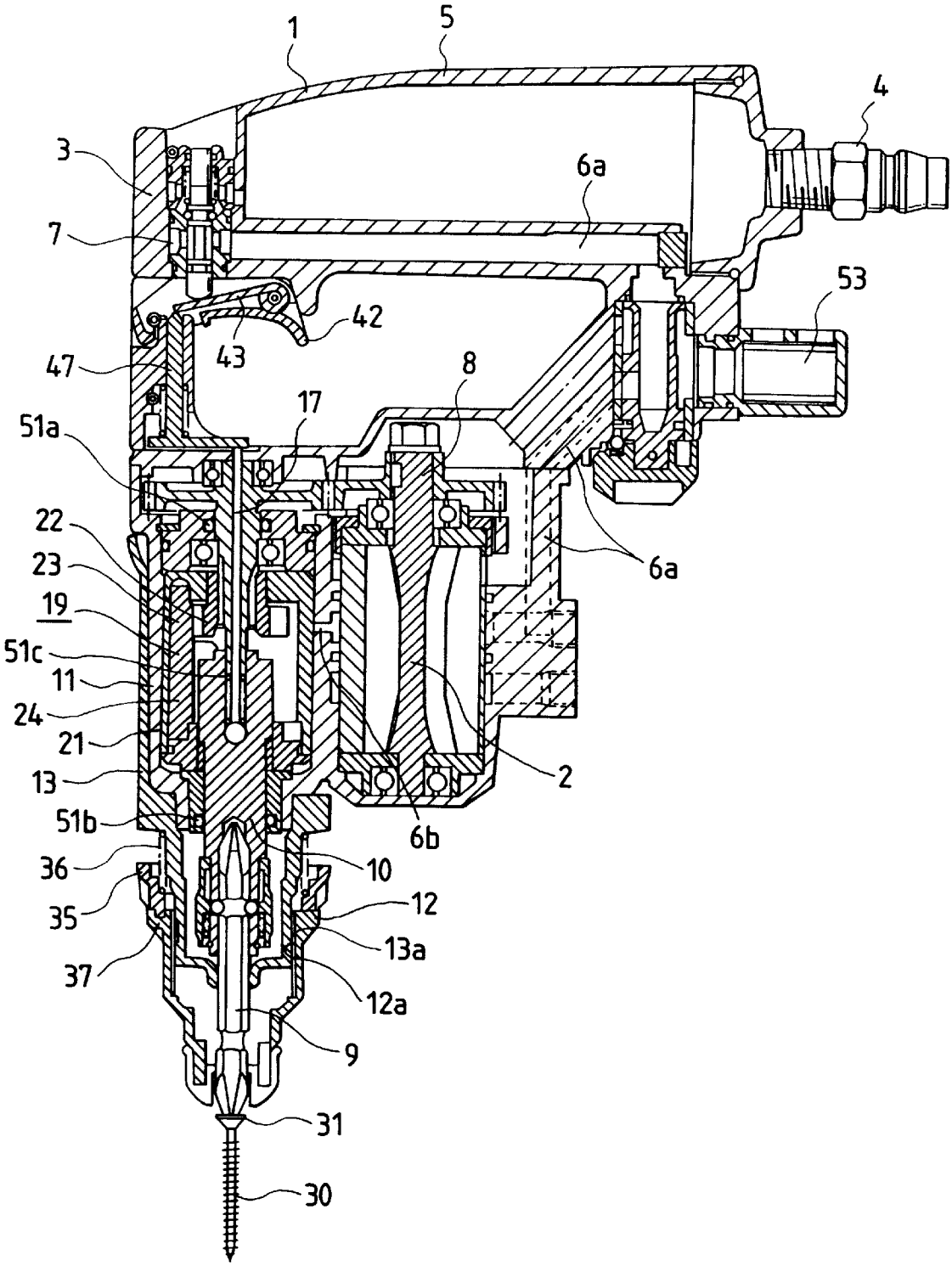
FIG. 3 is a vertical cross-sectional view showing the pneumatically operable screw driver shown in FIG. 1 which is equipped with a driver guide in accordance with the preferred embodiment of the present invention.

As shown in FIG. 3, a guide attachment 13 is provided around the nose casing 11. The guide attachment 13 has a cylindrical hollow body with a threaded portion 13*a* at the front end thereof. A driver guide 12 is detachably engaged with the guide attachment 13. The driver guide 12 has a cylindrical hollow body with a threaded portion 12*a* at a rear end thereof. The threaded portion 12*a* of the driver guide 12 is engaged with the threaded portion 13*a* of the guide attachment 13. The cylindrical hollow body of the driver guide 12 is thus telescopically coupled and arranged in tandem with the cylindrical hollow body of the guide attachment 13.

The driver bit 9 extends in the axial direction through the holes opened on the cylindrical hollow bodies of the driver guide 12 and the guide attachment 13. In other words, the driver guide 12 and the guide attachment 13 cooperatively cover the front portion of the driver bit 9 protruding out of the nose casing 11. The driver bit 9 is slidable in the axial direction relative to the driver guide 12 and the guide attachment 13. The through hole of the guide attachment 13 is positioned at the same height as the proximal end of the protruding portion of the driver bit 9. The through hole of the driver guide 12 is positioned at the same height as the distal end of the protruding portion of the driver bit 9. The axial position of the driver guide 12 is adjustable by rotating the driver guide 12 relative to the guide attachment 13. The protruding amount of the driver bit 9 from the lower end of the driver guide 12 is thus flexibly changed by adjusting the axial position of the driver guide 12. The fastening amount of the screw 30 into the board member 29 is thus adjustable flexibly.

An engaging recess (or projection) 37 is provided at the upper end of the driver guide 12. An engaging ring 35, provided at the guide attachment 13, is engageable with the engaging recess 37. The engaging ring 35 is shiftable in the axial direction against a resilient force of a spring 36. When the engaging ring 35 engages with the engaging recess 37, the driver guide 12 is prevented from rotating. When the engaging ring 35 shifts upward against the resilient force of the spring 36, the driver guide 12 is rotatable around the guide attachment 13 so as to change the axial position of the driver guide 12 relative to the guide attachment 13.

Figure 7A:
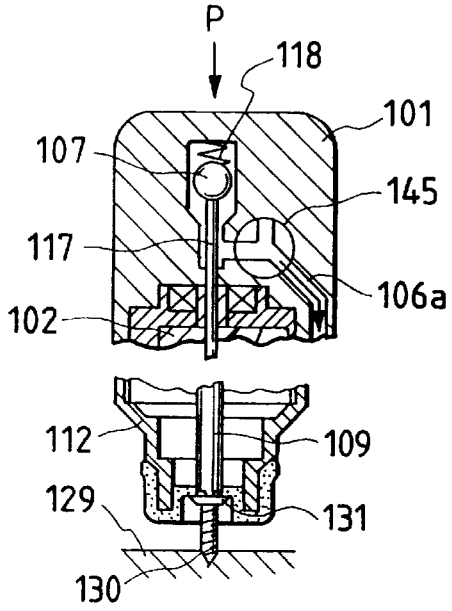
FIG. 7A PRIOR ART
FIGS. 7A to 7C are cross-sectional views cooperatively showing a screw driving operation of the conventional screw driver.
Figure 7B:
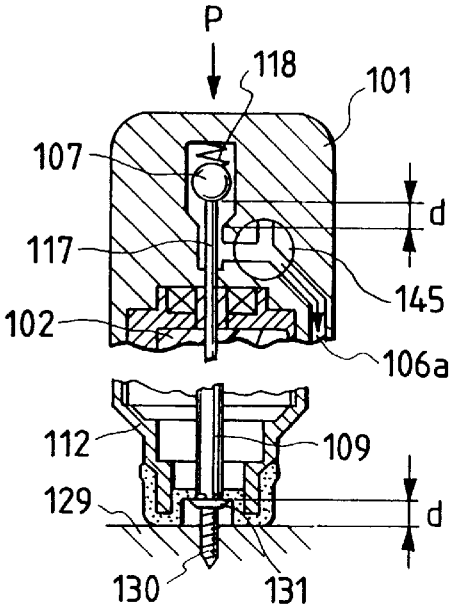
FIG. 7B PRIOR ART
Figure 7C:
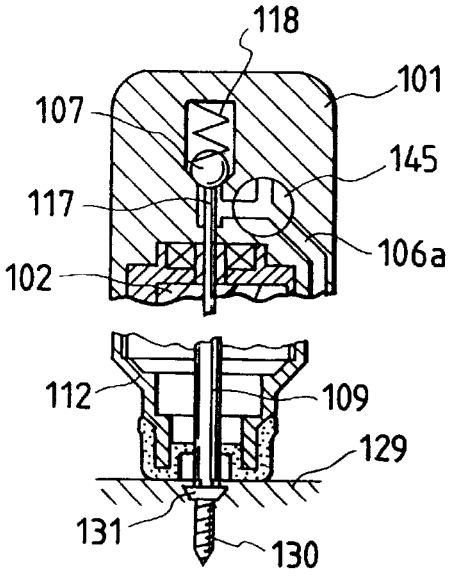
FIG. 7C PRIOR ART

The screw driving operation of the above-described screw driver is basically identical with that of the conventional screw driver explained with reference to FIGS. 7A to 7C.

Figure 4:
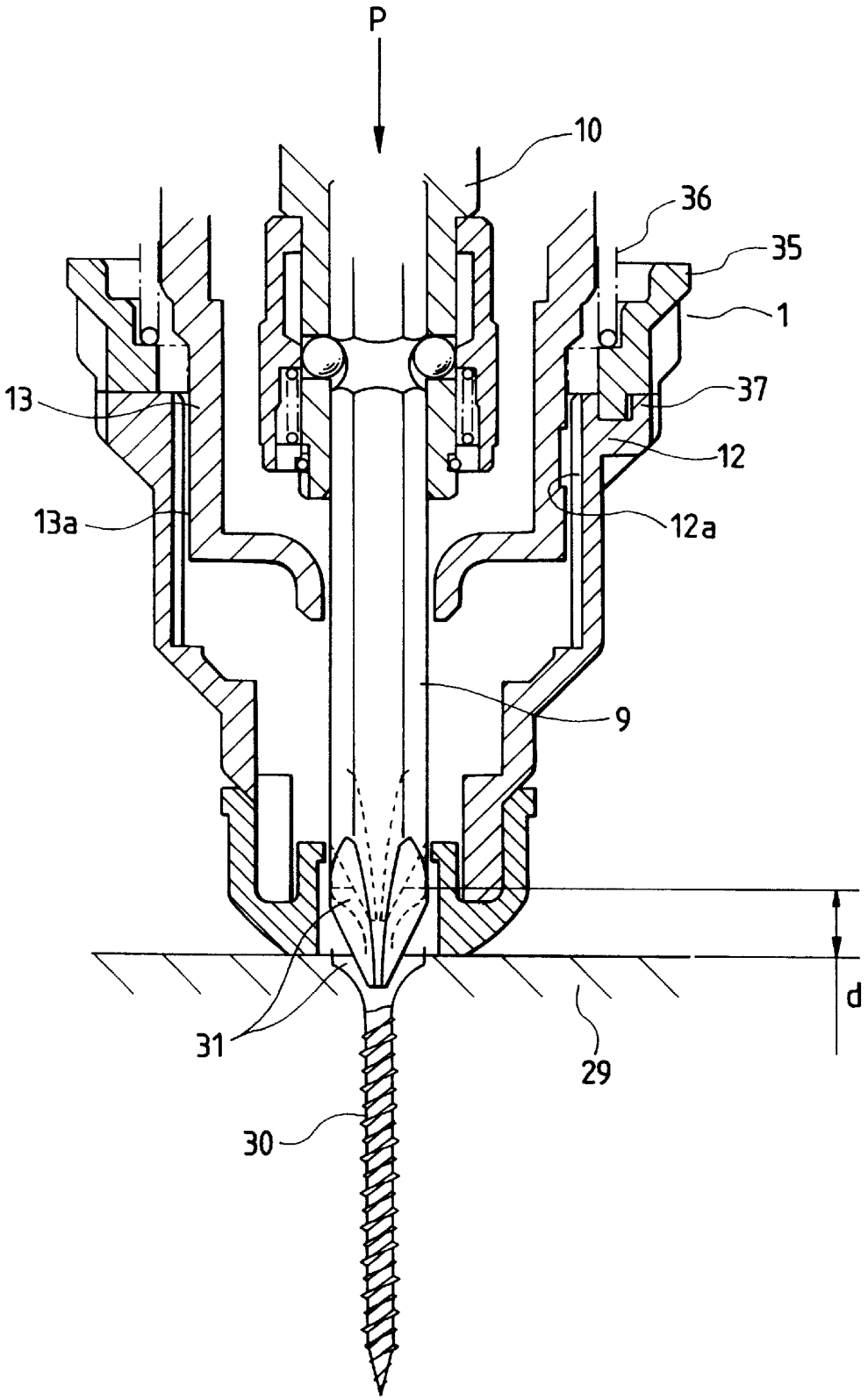
FIG. 4 is an enlarged cross-sectional view showing a screw driving operation of the pneumatically operable screw driver shown in FIG. 3.

During the screw driving operation, the front end of the driver guide 12 is brought into contact with the board member 29 when the screw head 31 reaches an altitudinal height "d" from the board member 29, as indicated by a dotted line in FIG. 4. After the driver guide 12 is brought into contact with the board member 29, the driver bit 9 and the anvil 10 do not receive the reaction force from the board member 29. The screw 30 is further driven or inserted into the board member 29. The driver bit 9 continuously advances in the protrusile direction relative to the screw driver body 1 to drive the screw 30 into the board member 29 until the intake valve 7 is closed. When the driver bit 9 completely shifts downward by the distance "d," the screw head 31 is positioned in flush with the upper surface of the board member 29, as indicated by a solid line in FIG. 4. At this moment, the air motor 2 is stopped. The screw driving operation is completed.

In this condition, the inside space of the nose casing 11 is filled with the compression air. The pressure of the compression air is applied as a pressing force on the rear end surface of the anvil 10. With this pressing force, the driver bit 9 surely drives the screw 30 against the reaction force. Thus, the "come-out" phenomenon is surely suppressed.

Due to inertia, the air motor 2 keeps rotating for a while even after the intake valve 7 is closed. Thus, the screw driving operation is substantially extended. According to the present invention, the compression air in the nose casing 11 is discharged through the auxiliary passage 6*b*. The auxiliary passage 6*b* has a narrow cross section capable of substantially delaying the discharge of the compression air. Hence, the pressure in the nose casing 11 is maintained for a while at higher levels. The pressure of the residual compression air is applied as a pressing force on the rear end surface of the anvil 10. With this pressing force, the driver bit 9 surely drives the screw 30 against the reaction force. The "come-out" phenomenon is surely suppressed.

Figure 5:
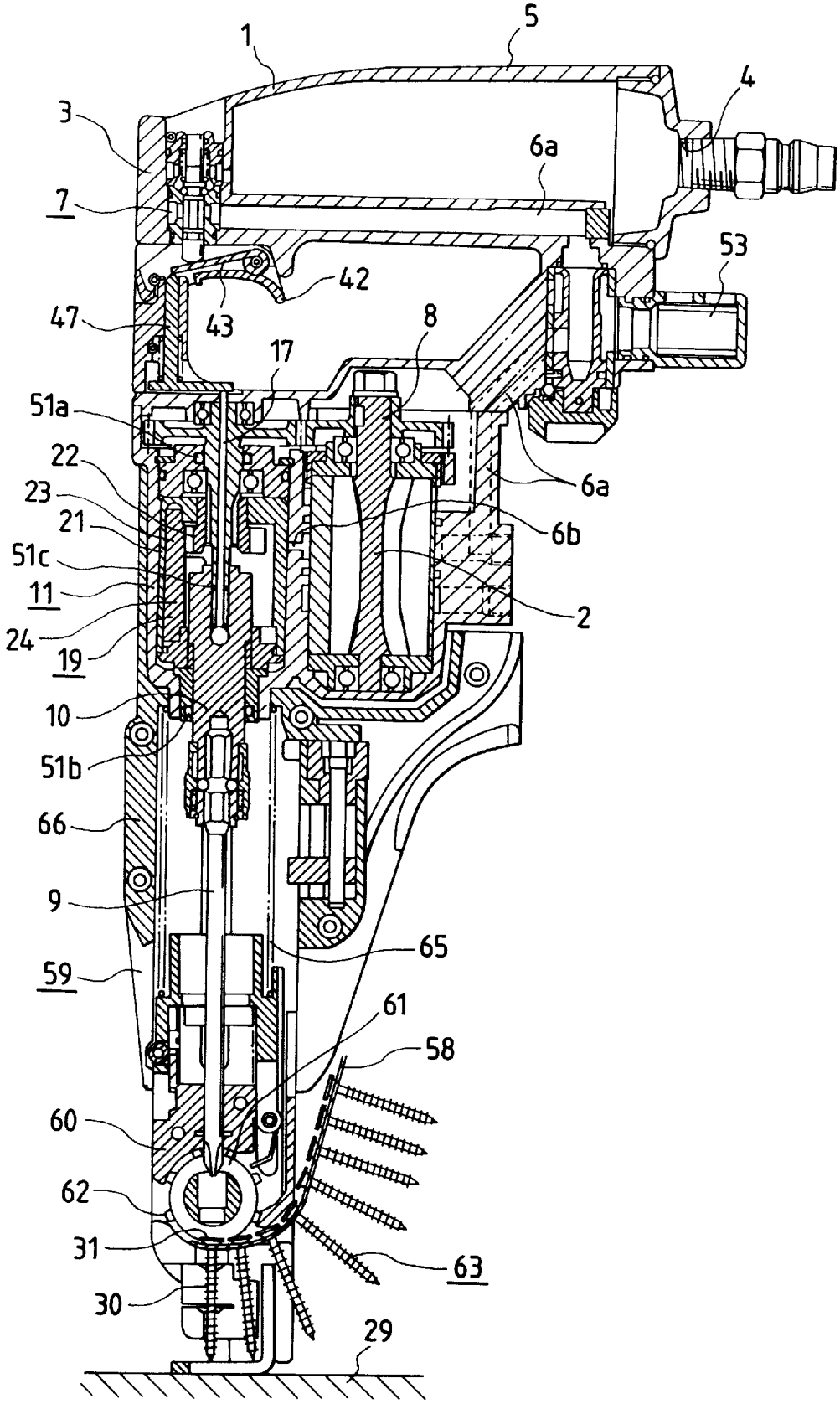
FIG. 5 is a vertical cross-sectional view showing another pneumatically operable screw driver equipped with a screw feeding mechanism in accordance with the preferred embodiment of the present invention.

FIG. 5 shows another pneumatically operable screw driver in accordance with the preferred embodiment of the present invention. The screw driver shown in FIG. 5 is equipped with a screw feeding mechanism 59. According to this embodiment, a plurality of screws 30 are connected by a flexible band 58 so as to form a screw assembly 63. The screw feeding mechanism 59 successively feeds each screw 30 at a position below the driver bit 9.

U.S. Pat. No. 4,059,034 or Japanese Utility Model Publication No. 7-18531 discloses a similar screw feeding mechanism.

The screw feeding mechanism 59 comprises a cylindrical body 66 attached to the front end of the screw driver body 1. A slider 60 is held by the cylindrical body 66 and slidable in the axial direction of the driver bit 9. The slider 60 is always urged in a protrusile direction (i.e., downward) by a resilient force of a spring 65. The flexible band 58 of the screw assembly 63 is detachably held along the front end of the slider 60. A wheel 61 is rotatably supported at the front end of the slider 60. A plurality of projections 62 are provided at uniform intervals along the cylindrical outer periphery of the wheel 61. The wheel 61 engages the flexible band 58 and rotates about its shaft to supply each screw 30 to the position meeting with the axis of the driver bit 9 in synchronism with the sliding motion of the slider 60.

The slider 60 is shifted upward. The tip of the driver bit 9 is engaged with the screw head 31. The screw 30 is removed from the flexible band 58. The intake valve 7 is opened in response to the upper shift movement of the driver bit 9 and the anvil 10. The compression air is introduced into the inside space of the nose casing 11. The pressure of the compression air is applied to the rear end surface of the anvil 10, as an assist force for removing the screw 30 from the flexible band 58. Meanwhile, with this pressing force, the driver bit 9 surely drives the screw 30 against the reaction force so as to suppress the "come-out" phenomenon.

Figure 6:
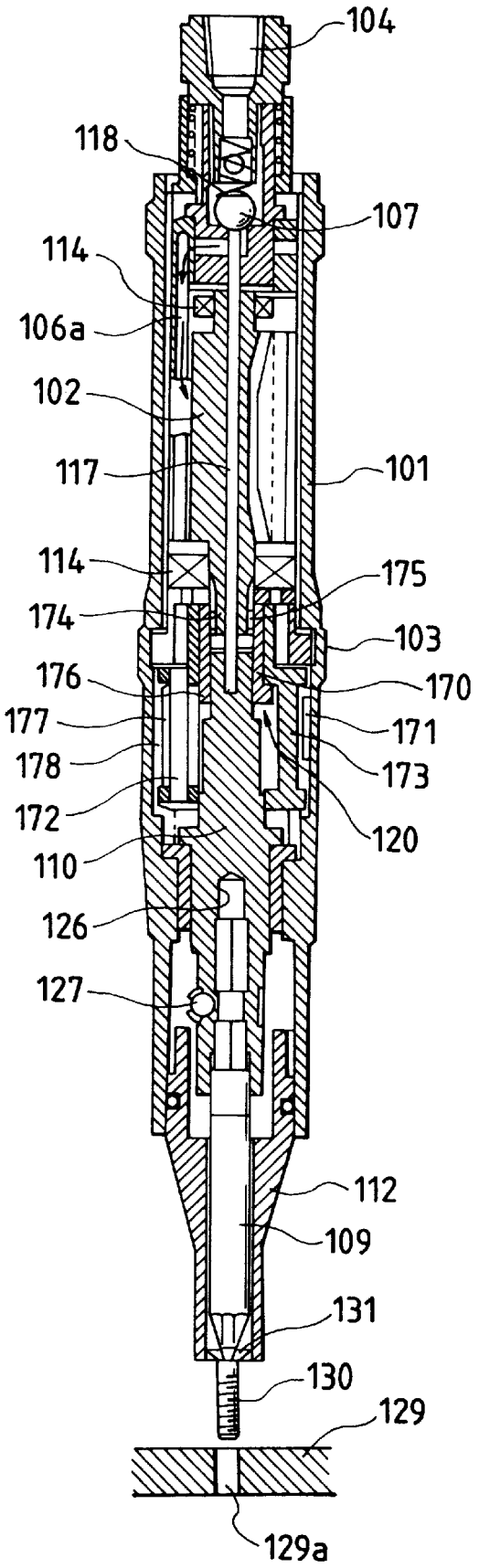
FIG. 6 PRIOR ART
FIG. 6 is a cross-sectional view showing a conventional screw driver.

The impact mechanism 19 disclosed in the above-described embodiments can be replaced by the speed-reduction mechanism 120 of the above-described conventional screw driver. As shown in FIG. 6, the speed-reduction mechanism 120 comprises a gear housing 173. A cylindrical gear 170 is provided in the gear housing 173. The planetary gear 172 meshes with the gear 170 and an internal gear 171 formed on an inside wall of the housing 103.

The cylindrical gear 170 and the gear housing 173 are coaxial with and rotatable about a rotary shaft 174 of the air motor 102. The cylindrical gear 170 has an internal gear on its inner cylindrical surface and an external gear 176 on its outer cylindrical surface. The internal gear of the cylindrical gear 170 is engaged with a gear 175 fixed around the rotary shaft 174 of the air motor 102. The external gear 176 of the cylindrical gear 170 is engaged with a gear 177 of the planetary gear 172. The planetary gear 172 is rotatably provided at an outer peripheral end of the gear housing 173. The planetary gear 172 meshes with an internal gear 178 formed on an inside wall of the housing 103. The rotation of the cylindrical gear 170 is transmitted to the planetary gear 172. The rotation of the planetary gear 172 is transmitted to the gear housing 173. The rotation speed of the air motor 102 is identical with that of the cylindrical gear 170. The gear housing 173 rotates at a reduced speed corresponding to a gear ratio determined in the relationship between the cylindrical gear 170 and the planetary gear 172 and also between the planetary gear 172 and the internal gear 178.

In FIG. 6, the air motor 102 is coaxial with the anvil 110 and the driver bit 109. The air motor 102 are rotatably supported by bearings 114 and 114 at axial ends thereof. The driver bit 109 is securely coupled in a bore 126 formed at the front end of the anvil 110. A ball 127 is engaged in a hole opened at a front end sleeve of the anvil 110 to lock the driver bit 109 so as not to move in the axial direction. As shown in FIGS. 7A to 7C, a switching valve 145 is provided in the air passage 106*a* to switch the rotational direction of the air motor 102.

According to the present invention, it is possible to modify the arrangement of the above-described screw driver. For example, the auxiliary passage 6*b* may have a cross section (or diameter) equal to or larger than that of the air passage 6*a*. In this case, the inside pressure of the nose casing 11 promptly increases as soon as the air motor 2 starts rotating. The pressing force acting on the rear end surface of the anvil 10 is quicky increased. Its increasing speed is sufficiently fast compared with the fastening speed of the driver bit 109. This is effective to suppress the "come-out" phenomenon especially when the board member 29 is made of a soft material, such as a gypsum or plaster board.

It is, however, preferable to use the auxiliary passage 6*b* exclusively for introducing the compression air. Instead, an independent exhaust passage having a smaller cross section (or diameter) is provided to suppress the sudden drop of the inside pressure in the nose casing 11.

The inside space of the nose casing 11 needs not be completely hermetical. For example, a small amount of leakage of the compression air will be allowed as long as the pressure level in the nose casing 11 can increase up to a satisfactory level.

Furthermore, instead of communicating with the air passage 6*a*, the auxiliary passage 6*b* may be directly connected to the intake port 4 in response to the opening of the intake valve 7.

Furthermore, instead of using a single auxiliary passage 6*b*, it is possible to provide two separate auxiliary passages communicating with the inside space of the nose casing 11, one for introducing the compression air and the other for discharging the compression air.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A pneumatically operable screw driver comprising:

a housing with an intake port connected to a compression air source supplying compression air;

an air motor provided in said housing and driven by the compression air introduced from said intake port;

an anvil having a rear end accommodated in said housing and a front end protruding out of said housing;

a transmission mechanism provided between said air motor and said anvil for transmitting the rotation of said air motor to said anvil;

a driver bit securely held at a front end of said anvil so as to be shiftable together with said anvil relative to said housing;

a resilient means for resiliently urging said driver bit and said anvil in a protrusile direction and also allowing said driver bit and said anvil to shift in a retractile direction relative to said housing when said driver bit receives a reaction force from a screw inserted into a board member;

an air passage connecting said intake port to said air motor;

an intake valve responsive to an retractile shift movement of said driver bit to open said air passage and supplying the compression air from said intake port to said air motor so as to rotate said air motor, and closing said air passage in response to a protrusile shift movement of said driver bit returning to its original position so as to stop said air motor; and an assist mean for applying a pressure of the compression air to a rear end surface of said anvil in response to the rotation of said air motor, wherein the compression air is introduced into an inside space of said housing to apply the pressure of the compression air to said rear end surface of said anvil in response to the rotation of said air motor, and the compression air is discharged in response to the stop of said air motor.

2. The pneumatically operable screw driver in accordance with claim 1, wherein an auxiliary passage is provided to introduce the compression air to said inside space of said housing facing said rear end surface of said anvil.

3. The pneumatically operable screw driver in accordance with claim 2, wherein said inside space of said housing facing said rear end surface of said anvil is hermetically sealed so that the introduced compression air is stored at a satisfactory pressure level in said inside space.

4. The pneumatically operable screw driver in accordance with claim 2, wherein said auxiliary passage has a cross section smaller than that of said air passage connecting said intake port to said air motor.

5. The pneumatically operable screw driver in accordance with claim 1, wherein an auxiliary passage is provided to discharge the compression air from said inside space of said housing facing said rear end surface of said anvil.

6. The pneumatically operable screw driver in accordance with claim 5, wherein said auxiliary passage has a cross section smaller than that of an exhaust passage discharging the compression air from said air motor.

7. The pneumatically operable screw driver in accordance with claim 1, wherein an auxiliary passage is connected to said air passage connecting said intake port to said air motor.

8. The pneumatically operable screw driver in accordance with claim 1, wherein said driver bit is surrounded by a driver guide, and said driver guide is detachably attached to said housing and slidable in an axial direction of said housing so that a protruding length of said driver bit can be adjusted by shifting said driver guide relative to said housing.

9. The pneumatically operable screw driver in accordance with claim 1, wherein a screw feeding mechanism is detachably attached to said housing.

10. The pneumatically operable screw driver in accordance with claim 9, wherein said screw feeding mechanism comprises a slider resiliently urged in a protrusile direction by a spring and slidable in an axial direction of said driver bit, and a wheel having a cylindrical outer periphery along which a plurality of projections are provided at uniform intervals to hold a flexible band of a screw assembly, and said wheel is rotatably supported at a front end of said slider to supply each screw of said screw assembly to a position meeting with the axis of said driver bit in synchronism with the sliding motion of the slider.

* * * * *